US006122916A

United States Patent [19]

Amos et al.

[11] Patent Number: 6,122,916

[45] Date of Patent: Sep. 26, 2000

[54] PILOT CONES FOR DRY LOW-$NO_X$ COMBUSTORS

[75] Inventors: David J. Amos; Mitchell O. Stokes, both of Orlando, Fla.

[73] Assignee: Siemens Westinghouse Power Corporation, Orlando, Fla.

[21] Appl. No.: 09/002,546

[22] Filed: Jan. 2, 1998

[51] Int. Cl.[7] ..... F23R 3/14; F23R 3/34

[52] U.S. Cl. ..... 60/747; 60/748

[58] Field of Search ..... 60/39.11, 39.826, 60/746, 747, 748

[56] References Cited

U.S. PATENT DOCUMENTS

| | | | |
|---|---|---|---|
| 3,154,516 | 10/1964 | Seifferlein . | |
| 3,919,840 | 11/1975 | Markowski . | |
| 4,051,671 | 10/1977 | Brewer . | |
| 5,048,433 | 9/1991 | Green et al. . | |
| 5,121,597 | 6/1992 | Urushidani et al. | 60/747 |
| 5,349,812 | 9/1994 | Taniguchi et al. | 60/747 |
| 5,410,884 | 5/1995 | Fukue et al. | 60/747 |
| 5,415,000 | 5/1995 | Mumford et al. | 60/747 |
| 5,461,865 | 10/1995 | Snyder et al. . | |
| 5,901,555 | 5/1999 | Mandai et al. | 60/747 |

FOREIGN PATENT DOCUMENTS

| | | |
|---|---|---|
| 0 594 127 A1 | 4/1994 | European Pat. Off. . |
| 08014562 | 1/1996 | European Pat. Off. . |
| 654 122 | 6/1951 | United Kingdom . |

*Primary Examiner*—Louis J. Casaregola

*Attorney, Agent, or Firm*—Eckert Seamans Cherin & Mellott, LLC

[57] ABSTRACT

A gas turbine combustor is provided having a nozzle housing adjacent to a main combustion zone, a diffusion fuel pilot nozzle, at least one main nozzle extending through the nozzle housing and attached thereto, and a parabolic pilot cone projecting from the vicinity of an injection port of the pilot nozzle. The parabolic pilot cone has a diverged end adjacent to the main combustion zone, and a parabolic profile forming a pilot flame zone adjacent to the injection port and the diverged end. The increased volume of the pilot flame zone provide a more stable pilot flame. The more stable pilot flame and leaner fuel/air mixture reduce $NO_x$/CO emissions. A second gas turbine combustor is provided having a fluted pilot cone. The fluted pilot cone has an undulated diverged end adjacent to the main combustion zone forming a pilot flame zone adjacent to the injection port and the undulated diverged end. The undulated diverged end of the fluted pilot cone creates turbulence in the main combustion zone. The turbulence results in greater interaction between main and pilot combustion zones, consequently reducing $NO_x$/CO emissions.

6 Claims, 5 Drawing Sheets

PILOT CONES FOR DRY LOW-$NO_X$ COMBUSTORS

FIELD OF THE INVENTION

The present invention relates to combustors for gas turbine engines. More specifically, the present invention relates to pilot cones that reduce nitrogen oxide and carbon monoxide emissions produced by lean premix combustors.

BACKGROUND OF THE INVENTION

Gas turbines are known to comprise the following elements: a compressor for compressing air; a combustor for producing a hot gas by burning fuel in the presence of the compressed air produced by the compressor; and a turbine for expanding the hot gas produced by the combustor. Gas turbines are known to emit undesirable oxides of nitrogen ($NO_x$) and carbon monoxide (CO). One factor known to affect $NO_x$ emission is combustion temperature. The amount of $NO_x$ emitted is reduced as the combustion temperature is lowered. However, higher combustion temperatures are desirable to obtain higher efficiency and CO oxidation.

Two-stage combustion systems have been developed that provide efficient combustion and reduced $NO_x$ emissions. In a two-stage combustion system, diffusion combustion is performed at the first stage for obtaining ignition and flame stability. Premixed combustion is performed at the second stage to reduce $NO_x$ emissions.

The first stage, referred to hereinafter as the "pilot" stage, is normally a diffusion-type burner and is, therefore, a significant contributor of $NO_x$ emissions even though the percentage of fuel supplied to the pilot is comparatively quite small (often less than 10% of the total fuel supplied to the combustor). The pilot flame has thus been known to limit the amount of $NO_x$ reduction that could be achieved with this type of combustor.

Pending U.S. patent application Ser. No. 08/759,395, assigned to the same assignee hereunder, (the '395 application) discloses a typical prior art gas turbine combustor 100. As shown in FIG. 1 herein, the combustor 100 comprises a nozzle housing 6 having a nozzle housing base 5. A diffusion fuel pilot nozzle 1 having a pilot fuel injection port 4 extends through nozzle housing 6 and is attached to nozzle housing base 5. Main fuel nozzles 2 extend parallel to pilot nozzle 1 through nozzle housing 6 and are attached to nozzle housing base 5. Fuel inlets 16 provide fuel to main fuel nozzles 2.

A main combustion zone 9 is formed within liner 19. A pilot cone 20 projects from the vicinity of pilot fuel injection port 4 of pilot nozzle 1 and has a diverged end 22 adjacent to the main combustion zone 9. Pilot cone 20 has a linear profile 21 forming a pilot flame zone 23.

Compressed air 101 from compressor 50 flows between support ribs 7 through main fuel swirlers 8 into the main combustion zone 9. Each main fuel swirler 8 has a plurality of swirler vanes 80. Compressed air 12 enters pilot flame zone 23 through a set of stationary turning vanes 10 located inside pilot swirler 11. Compressed air 12 mixes with pilot fuel 30 within the pilot cone 20 and is carried into the pilot flame zone 23 where it combusts.

FIG. 2 shows an upstream view of combustor 100. As shown in FIG. 2, pilot nozzle 1 having pilot fuel injection port 4 is surrounded by a plurality of main fuel nozzles 2. A main fuel swirler 8, having a plurality of swirler vanes 80, surrounds each main fuel nozzle 2. The diverged end 22 of pilot cone 20 forms an annulus 18 with liner 19. Fuel/air mixture 103 flows through annulus 18 (out of the page) into main combustion zone 9 (not shown in FIG. 2).

It is known that gas turbine combustors such as those described in FIG. 1 emit oxides of nitrogen ($NO_x$), carbon monoxide (CO), and other airborne pollutants. While gas turbine combustors such as the combustor disclosed in the '395 application have been developed to reduce these emissions, current environmental concerns demand even greater reductions.

It is known that increased pilot flame stability affects $NO_x$ and CO emissions by allowing the pilot fuel to be decreased. The linear profile pilot cones known in the art are somewhat effective in controlling pilot flame stability by shielding the pilot flame from the influx of high velocity main gases. These pilot cones also form an annulus that prevents the main flame from moving upstream of the flame zone (flashback). However, constricted pilot recirculation zones and vortex shedding at the diverged ends of these pilot cones are known to cause instability in the pilot flame.

Similarly, it is known that leaner fuel/air mixtures burn cooler and thus decrease $NO_x$ emissions. One known technique for providing a leaner fuel mixture is to create turbulence to homogenize the air and fuel as much as possible before combustion. However, the pilot cones known in the art do little to create this type of turbulence.

As fuel mixtures become leaner, however, pilot flame stability becomes more important. That is, for a gas turbine combustor to be self-sustaining, the pilot flame must remain stable even in the presence of very lean fuel/air mixtures.

Thus, there is a need in the art for pilot cones that reduce $NO_x$ and CO emissions from gas turbine combustors by providing increased pilot flame stability with leaner fuel/air mixtures.

SUMMARY OF THE INVENTION

The present invention satisfies these needs in the art by providing gas turbine combustors having pilot cones that reduce $NO_x$ and CO emissions by allowing the stable combustion of leaner fuel/air mixtures.

A gas turbine combustor of the present invention comprises a nozzle housing adjacent to a main combustion zone, a pilot nozzle, at least one main nozzle extending through the nozzle housing and attached thereto, and a parabolic pilot cone projecting from the vicinity of an injection port of the pilot nozzle. The parabolic pilot cone has a diverged end adjacent to the main combustion zone, and a parabolic profile forming a pilot flame zone adjacent to the injection port and the diverged end.

A second gas turbine according to the present invention is disclosed comprising a fluted pilot cone. The fluted pilot cone has an undulated diverged end adjacent to the main combustion zone forming a pilot flame zone adjacent to the injection port and the undulated diverged end.

DETAILED DESCRIPTION OF THE PREFERRED EMBODIMENTS

Figure 3:
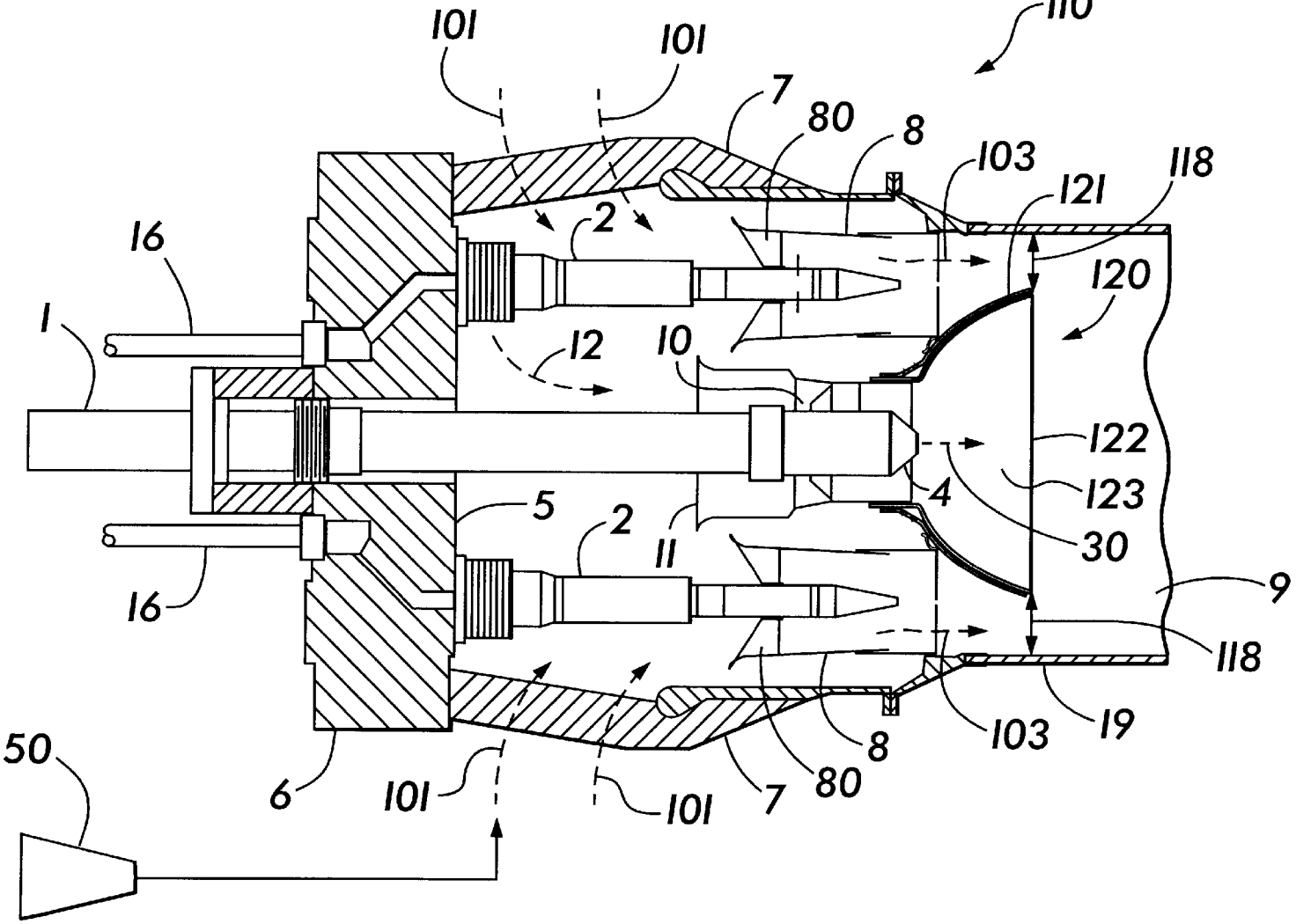
FIG. 3 shows a cross-sectional view of a gas turbine combustor comprising a parabolic pilot cone according to the present invention.

FIG. 3 shows a cross-sectional view of a gas turbine combustor 110 comprising a parabolic pilot cone 120 according to the present invention. As shown in FIG. 3, combustor 110 comprises a nozzle housing 6 having a nozzle housing base 5. A diffusion fuel pilot nozzle 1 having a pilot fuel injection port 4 extends through nozzle housing 6 and is attached to nozzle housing base 5. Main fuel nozzles 2 extend parallel to pilot nozzle 1 through nozzle housing 6 and are attached to nozzle housing base 5. Fuel inlets 16 provide fuel to main fuel nozzles 2.

A main combustion zone 9 is formed within liner 19 adjacent to nozzle housing 6. A parabolic pilot cone 120 projects from the vicinity of pilot fuel injection port 4 of pilot nozzle 1 and has a diverged end 122 adjacent to the main combustion zone 9. Parabolic pilot cone 120 has a parabolic profile 121 forming a pilot flame zone 123.

Compressed air 101 from compressor 50 flows between support ribs 7 through main fuel swirlers 8 into the main combustion zone 9. Each main fuel swirler 8 has a plurality of swirler vanes 80. Compressed air 12 enters pilot flame zone 123 through a set of stationary turning vanes 10 located inside pilot swirler 11. Compressed air 12 mixes with pilot fuel 30 within the parabolic pilot cone 120 and is carried into the pilot flame zone 123 where it combusts. The diverged end 122 of parabolic pilot cone 120 forms an annulus 118 with liner 19.

The parabolic profile 121 of parabolic pilot cone 120 provides for increased velocity of the fuel/air mixture 103 flowing into main combustion zone 9. The smoother shape of the parabolic profile 121 decreases the pressure drop through the annulus 118, thus increasing the velocity of the fuel/air mixture 103. The increased velocity in the fuel/air mixture 103 allows for a leaner mixture in main combustion zone 9 and, consequently, reduces $NO_x$/CO emissions.

Figure 1:
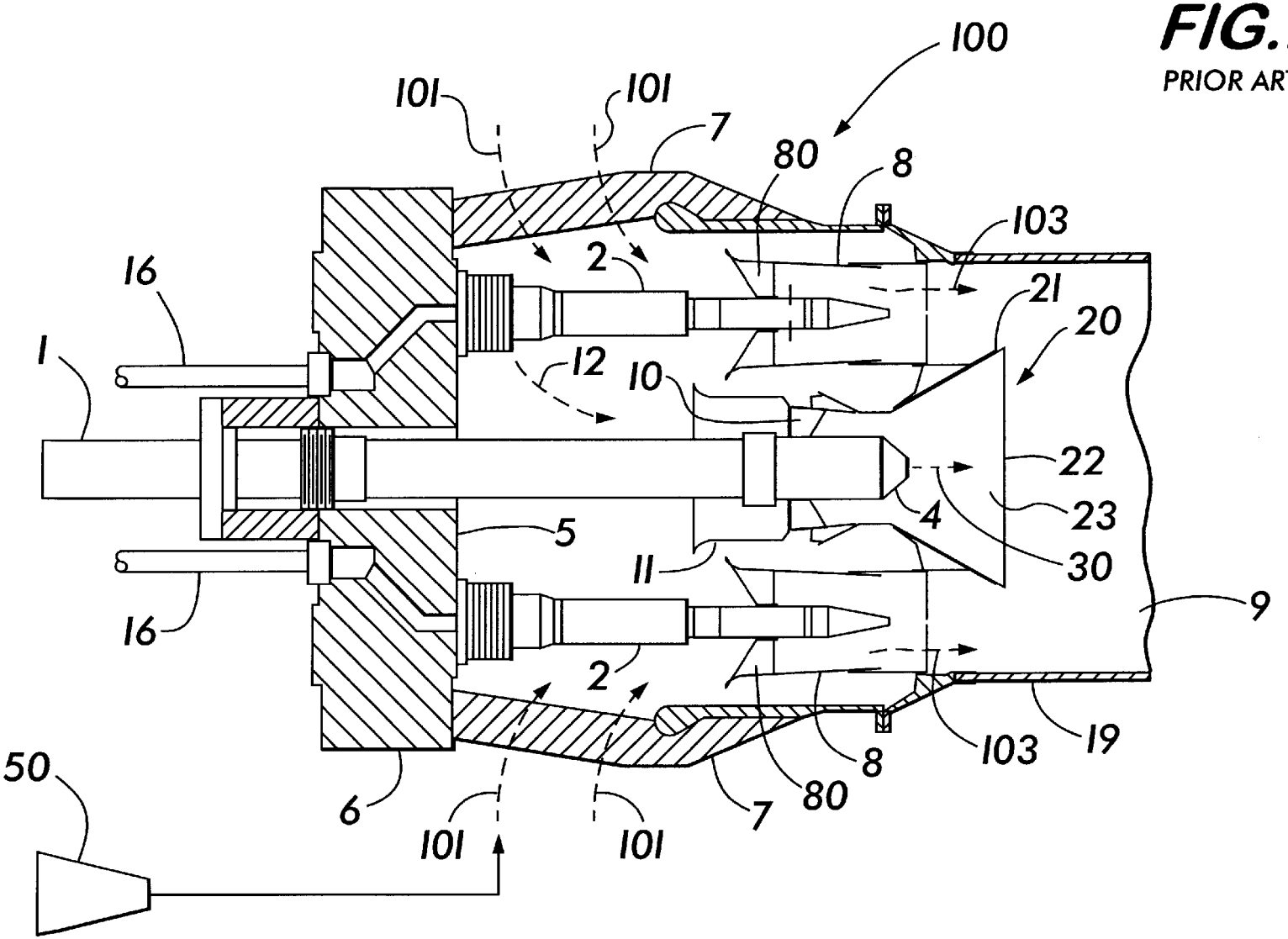
FIG. 1 PRIOR ART
FIG. 1 shows a cross-sectional view of a prior art gas turbine combustor.
Figure 2:
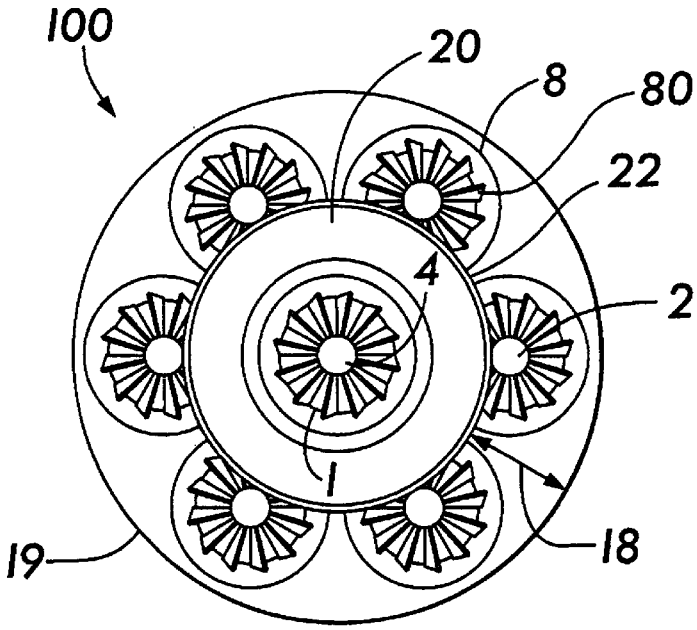
FIG. 2 PRIOR ART
FIG. 2 shows an upstream view of a prior art gas turbine combustor.

Thus, in a preferred embodiment of the present invention, the circumference of the diverged end 122 of the parabolic pilot cone 120 can be enlarged relative to the circumference of the diverged end 22 of the prior art pilot cone 20 shown in FIG. 1, while maintaining the same velocity of fuel/air mixture 103. The enlarged circumference of the diverged end 122 serves to further increase pilot flame stability, as well as to decrease the likelihood of flashback.

Figure 4:
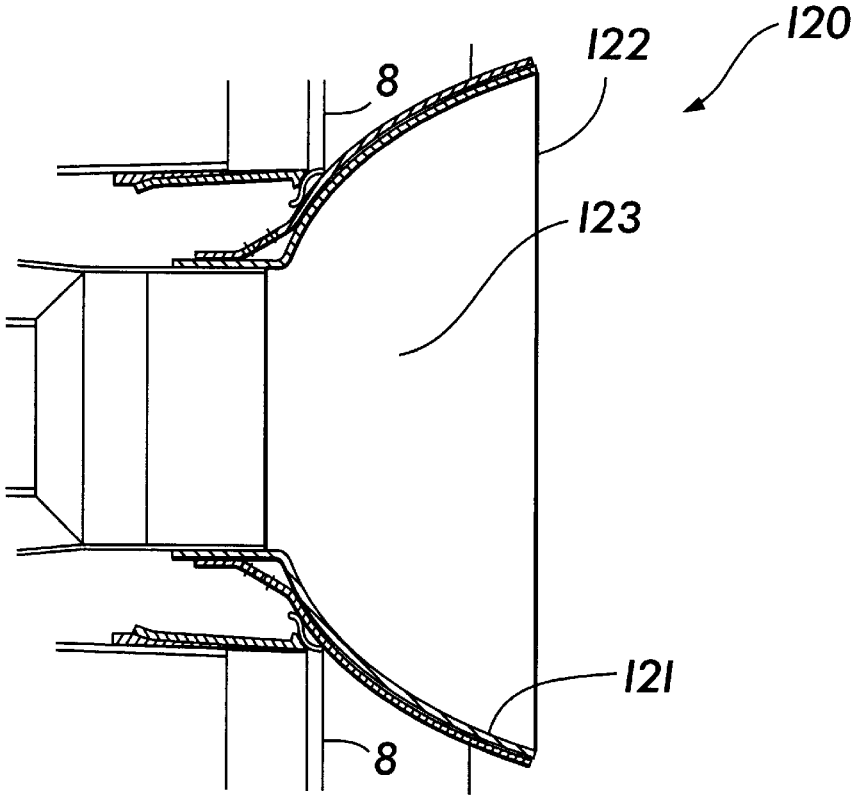
FIG. 4 shows a cross sectional view of a preferred embodiment of a parabolic pilot cone according to the present invention.

FIG. 4 shows a cross sectional view of a preferred embodiment of parabolic pilot cone 120 in greater detail. The parabolic profile 121 increases the volume of the pilot flame zone 123 over that of the pilot flame zone 23 of the prior art pilot cone 20 shown in FIG. 1. It is known that a larger pilot flame zone 123 provides greater pilot flame stability and, consequently, reduced $NO_x$/CO emissions.

Similarly, the larger effective area of the pilot flame zone 123 provides more air to the pilot flame. This serves to increase the heat release, while keeping the overall temperature within the pilot flame zone 123 constant. This higher heat release (while maintaining the same temperature) increases the overall combustion stability thus creating less $NO_x$ and CO emissions.

Pilot flame zone 123 is less constricted due the parabolic profile 121 than is pilot flame zone 23 shown in FIG. 1. Thus, pilot flame zone 123 allows the pilot flame to follow its natural aerodynamic flow better than the more constricted pilot flame zone 23 of the prior art pilot cone 20. Again, this provides for a more stable pilot flame and, consequently, reduced $NO_x$/CO emissions.

In the prior art combustor 100 shown in FIG. 1, the particular shape of the pilot profile creates vortex shedding off the diverged end 22 of the prior art pilot cone 20 and causing undesirable fluctuations in the heat release rate (HRR). The gradual slope of the parabolic profile 121, shown in FIG. 4, reduces such vortex shedding off the diverged end 122 of parabolic pilot cone 120. Reduced vortex shedding reduces the fluctuations in the HRR, thus producing an overall more stable pilot flame and, consequently, reducing $NO_x$/CO emissions.

Figure 5:
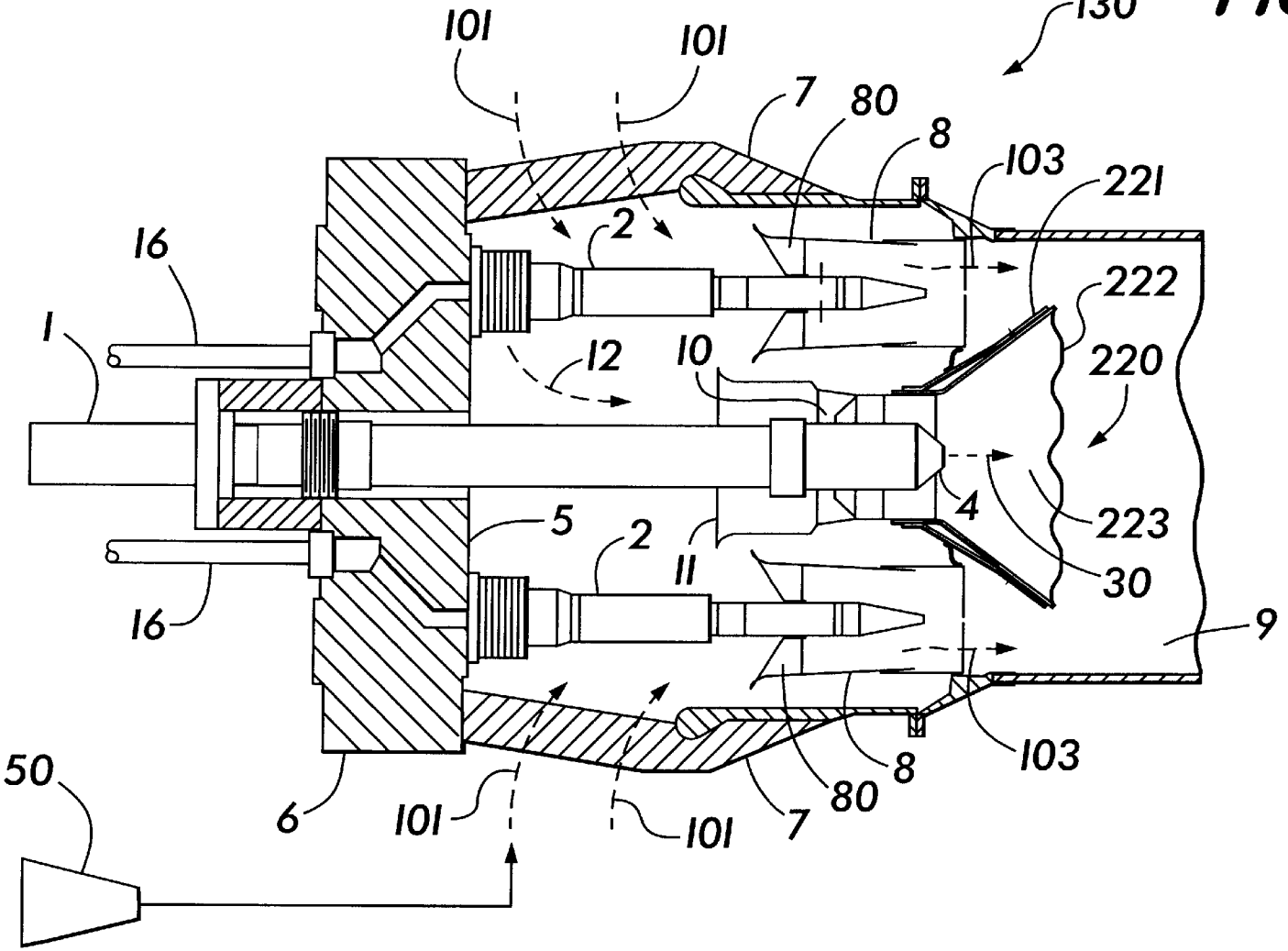
FIG. 5 shows a cross-sectional view of a gas turbine combustor comprising a fluted pilot cone according to the present invention.

FIG. 5 shows a cross-sectional view of a gas turbine combustor 130 comprising a fluted pilot cone 220 according to the present invention. As shown in FIG. 5, combustor 130 comprises a nozzle housing 6 having a nozzle housing base 5. A diffusion fuel pilot nozzle 1 having a pilot fuel injection port 4 extends through nozzle housing 6 and is attached to nozzle housing base 5. Main fuel nozzles 2 extend parallel to pilot nozzle 1 through nozzle housing 6 and are attached to nozzle housing base 5. Fuel inlets 16 provide fuel to main fuel nozzles 2.

A main combustion zone 9 is formed within liner 19. A fluted pilot cone 220 projects from the vicinity of pilot fuel injection port 4 of pilot nozzle 1 and has an undulated diverged end 222 adjacent to the main combustion zone 9. Fluted pilot cone 220 has a linear profile 221 forming a pilot flame zone 223.

Compressed air 101 from compressor 50 flows between support ribs 7 through main fuel swirlers 8 into the main combustion zone 9. Each main fuel swirler 8 has a plurality of swirler vanes 80. Compressed air 12 enters pilot flame zone 223 through a set of stationary turning vanes 10 located inside pilot swirler 11. Compressed air 12 mixes with pilot fuel 30 within the fluted pilot cone 220 and is carried into the pilot flame zone 223 where it combusts. Fluted pilot cone 220 improves the mixture of air and fuel in the main combustion zone 9 by increasing the turbulence between the pilot flame zone 223 and main combustion zone 9.

Figure 6:
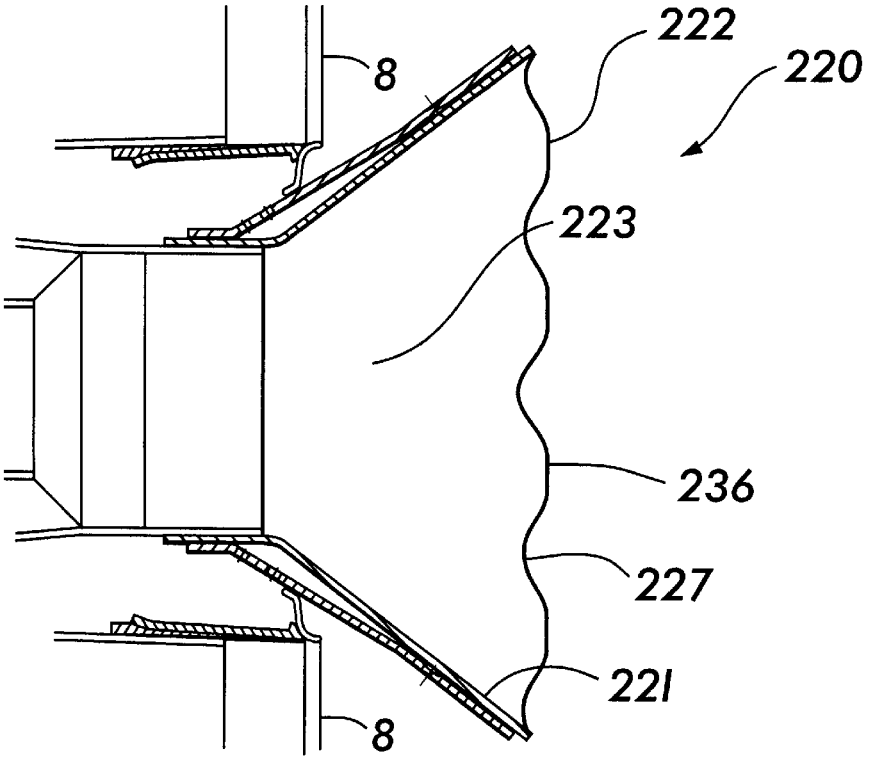
FIG. 6 shows a cross sectional view of a preferred embodiment of a fluted pilot cone according to the present invention.

FIG. 6 shows a cross sectional view of a preferred embodiment of fluted pilot cone 220 in greater detail.

Figure 7:
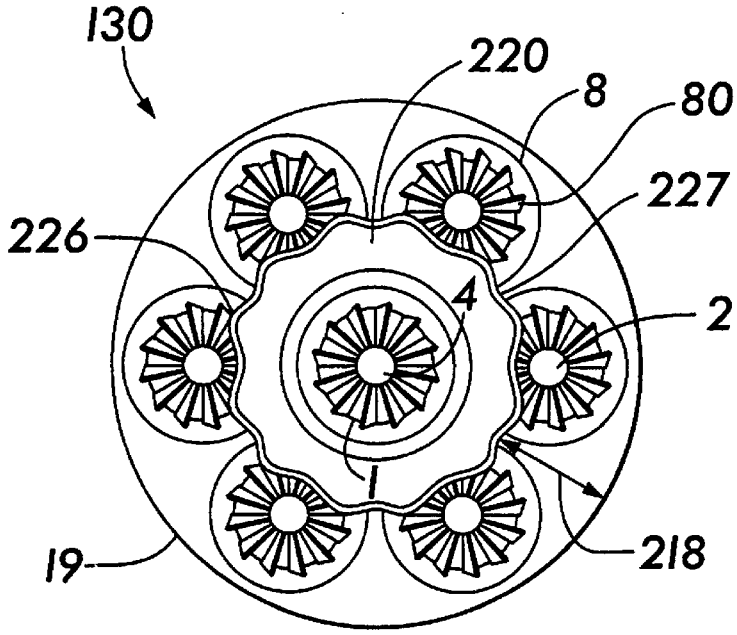
FIG. 7 shows an upstream view of a preferred embodiment of a gas turbine combustor comprising a fluted pilot cone according to the present invention.

FIG. 7 shows an upstream view of combustor 130. As shown in FIG. 7, pilot nozzle 1 having pilot fuel injection port 4 is surrounded by a plurality of main fuel nozzles 2. A main fuel swirler 8, having a plurality of swirler vanes 80, surrounds each main fuel nozzle 2. The undulated diverged end 222 of pilot cone 220 comprises a plurality of alternating lobes 226 and troughs 227. Undulated diverged end 222 forms an undulated annulus 218 with liner 19. Compressed air 101 flows through undulated annulus 218 (out of the page) into main combustion zone 9 (not shown in FIG. 7).

As shown in FIG. 7, the area of undulated annulus 218 is greater at the troughs 227 than at the lobes 226. As described above in connection with annulus 118, the greater the area of the undulated annulus 218, the lower the velocity of the fuel/air mixture 103 flowing into main combustion zone 9 (see FIG. 5). Thus, the undulated diverged end 222 of fluted pilot cone 220 provides for alternating regions of high and low velocity flow. The variance in the velocities causes turbulence which enhances mixing between fuel and air and creates a leaner fuel/air mixture 103 in main combustion zone 9. The leaner fuel/air mixture 103 reduces $NO_x$ and CO emissions.

Similarly, the variance in the velocities increases the interaction between the fuel/air mixture 103 in the pilot flame zone 223 and the combustion gases in the main combustion zone 9. This increased interaction allows the pilot flame to impart its heat to the fuel/air mixture 103 in the main combustion zone 9, permitting a lower temperature in the pilot flame zone 223. The lower temperature results in reduced $NO_x$ emissions.

The number of lobes 226 and troughs 227 shown in the FIGS. 5–7, as well as the alignment of the lobes and troughs relative to the main fuel nozzles, is exemplary only. It is contemplated that the number of lobes and troughs, as well as the alignment of the lobes and troughs relative to the main fuel nozzles, may vary depending on the aerodynamic conditions of the particular environment for optimal $NO_x$/CO reduction.

As described above in connection with the parabolic pilot cone 120, turbulence (e.g., vortex shedding) can decrease flame stability. However, as described above in connection with the fluted pilot cone 220, turbulence is known to improve mixing. Thus, it is contemplated that the parabolic profile 121 of the parabolic pilot cone 120 may be combined with the undulated diverged end 222 of the fluted pilot cone 220 to balance pilot flame stability against leaner fuel mixtures for optimal $NO_x$/CO reduction.

Those skilled in the art will appreciate that numerous changes and modifications may be made to the preferred embodiments of the invention and that such changes and modifications may be made without departing from the spirit of the invention. It is therefore intended that the appended claims cover all such equivalent variations as fall within the true spirit and scope of the invention.

What is claimed is:

1. A gas turbine combustor, comprising:

a nozzle housing having a nozzle housing base, a main combustion zone located adjacent to said nozzle housing;

a diffusion fuel pilot nozzle having a pilot fuel injection port, disposed on the axial centerline of said gas turbine combustor upstream of the main combustion zone, said pilot nozzle extending through said nozzle housing and attached to the nozzle housing base;

at least one main nozzle parallel to said pilot nozzle, said main nozzle extending through said nozzle housing and attached to the nozzle housing base; and a fluted pilot cone projecting from the vicinity of the pilot fuel injection port of said pilot nozzle, said fluted pilot cone having an undulated diverged end adjacent to the main combustion zone, said fluted pilot cone forming a pilot flame zone adjacent to the pilot fuel injection port and the undulated diverged end.

2. The gas turbine combustor of claim 1, further comprising:

at least one main fuel swirler parallel to said pilot nozzle and adjacent to the main combustion zone, said main fuel swirler surrounding said main nozzle.

3. The gas turbine combustor of claim 2, wherein each said main fuel swirler comprises a plurality of swirler vanes.

4. A gas turbine, comprising:

a) a compressor for compressing air;

b) a gas turbine combustor for producing a hot gas by burning a fuel in said compressed air, comprising:

i) a nozzle housing having a nozzle housing base, a main combustion zone located adjacent to said nozzle housing;

ii) a diffusion fuel pilot nozzle having a pilot fuel injection port, disposed on the axial centerline of said gas turbine combustor upstream of the main combustion zone, said pilot nozzle extending through said nozzle housing and attached to the nozzle housing base;

iii) at least one main nozzle parallel to said pilot nozzle, said main nozzle extending through said nozzle housing and attached to the nozzle housing base; and iv) a fluted pilot cone projecting from the vicinity of the pilot fuel injection port of said pilot nozzle, said fluted pilot cone having an undulated diverged end adjacent to the main combustion zone, said fluted pilot cone forming a pilot flame zone adjacent to the pilot fuel injection port and the undulated diverged end; and c) a turbine for expanding the hot gas produced by said gas turbine combustor.

5. The gas turbine of claim 4, wherein said gas turbine combustor further comprises:

at least one main fuel swirler parallel to said pilot nozzle and adjacent to the main combustion zone, said main fuel swirler surrounding said main nozzle.

6. The gas turbine of claim 5, wherein each said main fuel swirler comprises a plurality of swirler vanes.

* * * * *